US008911258B2

(12) United States Patent
Soubh et al.

(10) Patent No.: US 8,911,258 B2
(45) Date of Patent: Dec. 16, 2014

(54) RIGHT ANGLE TRANSITION ADAPTER WITH INTERCHANGEABLE GENDER COMPONENTS AND METHOD OF USE

(71) Applicants: Emad Soubh, Camas, WA (US); Jason Smith, Sartell, MN (US); John Grant, Sherborn, MA (US)

(72) Inventors: Emad Soubh, Camas, WA (US); Jason Smith, Sartell, MN (US); John Grant, Sherborn, MA (US)

(73) Assignee: AirBorn, Inc., Georgetown, TX (US)

( * ) Notice: Subject to any disclaimer, the term of this patent is extended or adjusted under 35 U.S.C. 154(b) by 0 days.

(21) Appl. No.: 13/676,053

(22) Filed: Nov. 13, 2012

(65) Prior Publication Data

US 2014/0134887 A1 May 15, 2014

(51) Int. Cl.

| | |
|---|---|
| ***H01R 25/00*** | (2006.01) |
| ***H01R 31/06*** | (2006.01) |
| ***H01R 13/514*** | (2006.01) |
| ***H01R 12/72*** | (2011.01) |

(52) U.S. Cl.

CPC ..... *H01R 31/06* (2013.01); *H01R 13/514* (2013.01); *H01R 12/724* (2013.01)

USPC ..... 439/638

(58) Field of Classification Search

CPC ..... H01R 12/724; H01R 13/514; H01R 31/06

USPC ..... 439/638, 607.31, 607.32, 607.11, 439/607.39, 246, 171–177

See application file for complete search history.

(56) References Cited

U.S. PATENT DOCUMENTS

| | | | | |
|---|---|---|---|---|
| 6,155,887 | A | 12/2000 | Cuff et al. | |
| 6,220,869 | B1 | 4/2001 | Grant et al. | |
| 6,318,632 | B1 | 11/2001 | Grant et al. | |
| 6,517,360 | B1 * | 2/2003 | Cohen | 439/65 |
| 6,877,992 | B2 | 4/2005 | Grant et al. | |
| 7,021,942 | B2 | 4/2006 | Grant et al. | |
| 7,187,076 | B2 | 3/2007 | Cuff et al. | |
| D543,508 | S | 5/2007 | Soubh et al. | |
| D549,659 | S | 8/2007 | Grant et al. | |
| D560,613 | S | 1/2008 | McEvoy et al. | |
| D560,614 | S | 1/2008 | McEvoy et al. | |
| D561,103 | S | 2/2008 | Grant | |
| D561,107 | S | 2/2008 | Cuff et al. | |
| D561,108 | S | 2/2008 | Cuff et al. | |
| D561,109 | S | 2/2008 | Howerton et al. | |
| D561,110 | S | 2/2008 | Howerton et al. | |
| D561,698 | S | 2/2008 | Cuff et al. | |
| D562,248 | S | 2/2008 | Howerton et al. | |
| D562,249 | S | 2/2008 | Howerton et al. | |
| D562,775 | S | 2/2008 | Cuff et al. | |
| D563,877 | S | 3/2008 | Grant | |
| D563,878 | S | 3/2008 | Grant | |
| D563,879 | S | 3/2008 | Grant | |
| D563,880 | S | 3/2008 | Grant | |
| D563,881 | S | 3/2008 | Howerton et al. | |
| D563,882 | S | 3/2008 | Howerton | |
| D563,883 | S | 3/2008 | Dever | |
| D563,884 | S | 3/2008 | Dever | |

(Continued)

*Primary Examiner* — Edwin A. Leon

(74) *Attorney, Agent, or Firm* — Locke Lord LLP

(57) ABSTRACT

A right angle transition adapter allows vertical connector components to be used in a right angle connector. The right angle transition adapter comprises a vertical connector housing, a wafer, overmolded lead frames, and a right angle transition housing. The overmolded lead frames can be mounted to a board while the vertical connector housing can connect with mating connectors as if it were a vertical connector.

14 Claims, 3 Drawing Sheets

(56) References Cited

U.S. PATENT DOCUMENTS

| | | | | |
|---|---|---|---|---|
| D563,885 | S | 3/2008 | Dever | |
| D563,886 | S | 3/2008 | Dever | |
| D563,887 | S | 3/2008 | Dever | |
| 7,798,852 | B2 * | 9/2010 | Laurx et al. | 439/607.08 |
| 8,182,289 | B2 * | 5/2012 | Stokoe et al. | 439/607.11 |
| 2011/0104948 | A1 * | 5/2011 | Girard et al. | 439/620.21 |

* cited by examiner

RIGHT ANGLE TRANSITION ADAPTER WITH INTERCHANGEABLE GENDER COMPONENTS AND METHOD OF USE

BACKGROUND OF THE INVENTION

1. Field of Invention

The present invention is directed to a right angle transition adapter with interchangeable gender components that is capable of converting a typical vertical electrical connector to a right angle electrical connector.

2. Description of Related Art

Other electrical connectors disclose a right angle feature. However, such connectors are either male or female connectors, and one gender connectors cannot be converted to the opposite gender. Thus, there is a need in the art for a right angle transition adapter with interchangeable gender components.

SUMMARY

The present invention is a right angle transition adapter for electrical connectors. The adapter comprises a vertical connector housing, a right angle transition housing, a wafer, and overmolded lead frames. The adapter can be mounted to a board, such as a printed circuit board ("PCB"), with the overmolded lead frames. The vertical connector housing can receive mating connectors as if it were a standard vertical connector. The overmolded lead frames are not gender-specific and are capable of mating with either a male or female wafer, which in turn allows the adapter to receive female or male mating connectors.

BRIEF DESCRIPTION OF THE DRAWINGS

The apparatus of the invention is further described and explained in relation to the following figures of the drawing wherein.

DETAILED DESCRIPTION OF THE PREFERRED EMBODIMENTS

Figure 1:
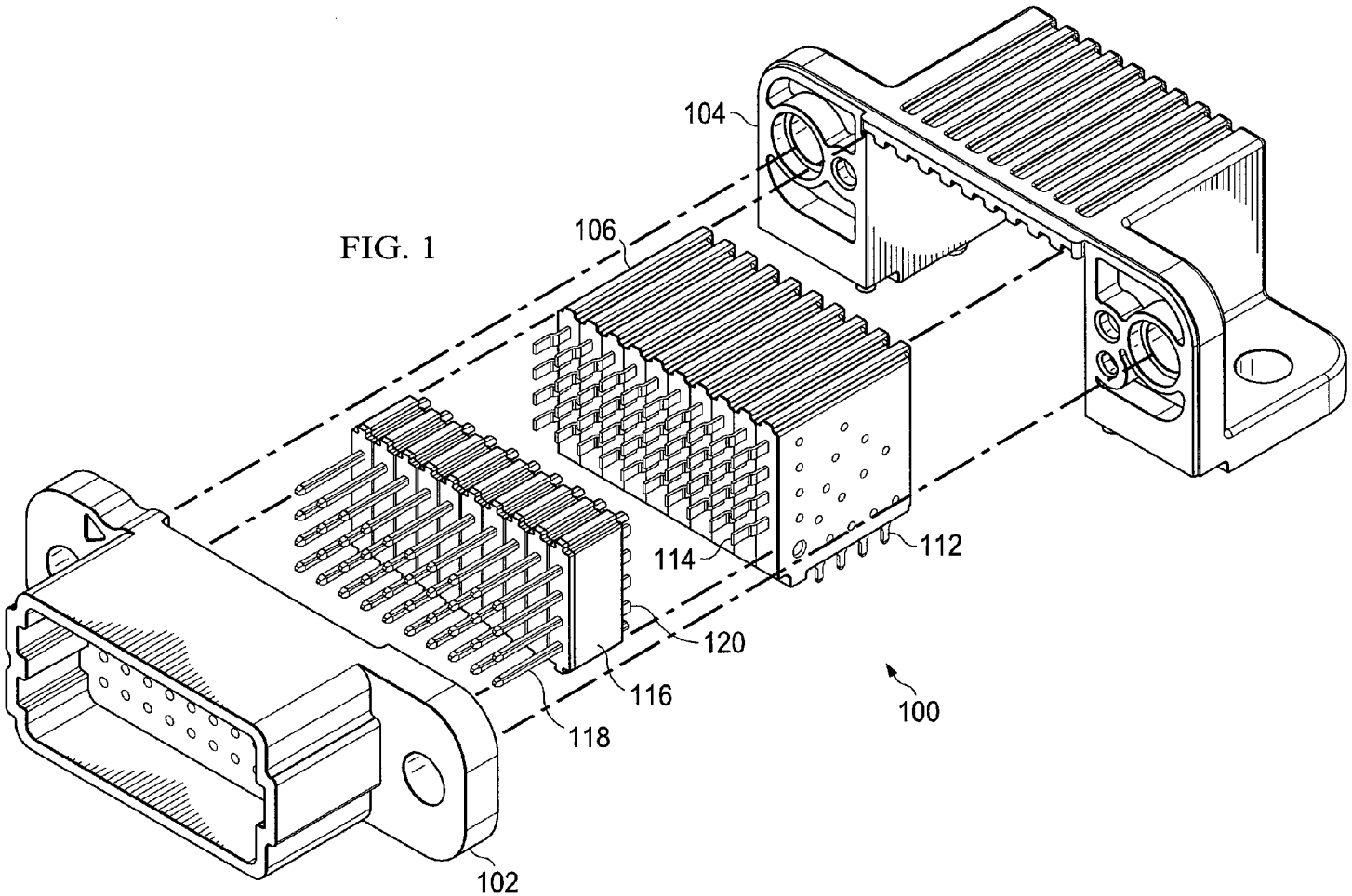
FIG. 1 is an exploded top perspective view of a right angle transition adapter.
Figure 2:
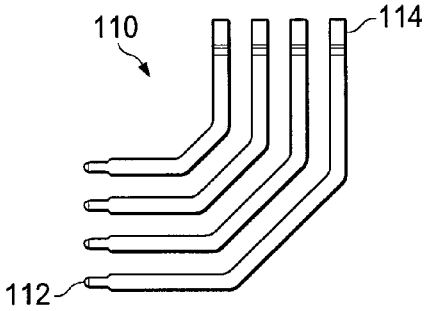
FIG. 2 is a top elevation view of a lead frame.
Figure 3:
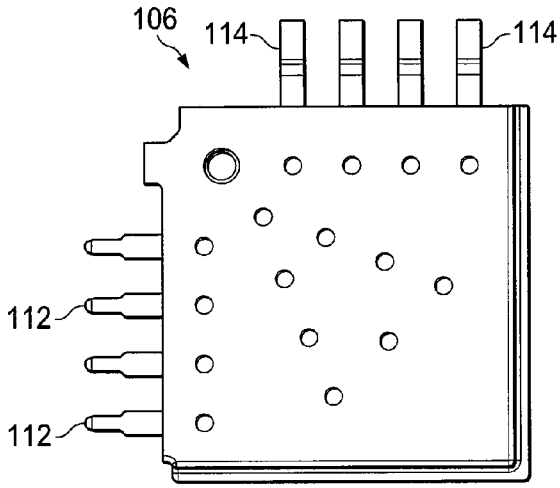
FIG. 3 is a top elevation view of an overmolded lead frame.

As shown in FIG. 1, right angle transition adapter 100 comprises a vertical connector housing 102, a plurality of wafers 116, a plurality of overmolded lead frames 106, and a right angle transition housing 104. As shown in FIGS. 2 and 3, an overmolded lead frame 106 comprises a lead frame 110 that contains attachment terminals 112 that are in perpendicular orientation to first attachment tabs 114. Attachment terminals 112 can connect to either a printed circuit board ("PCB") or a cable. Vertical connector housing 102 can be connected to mating connectors as if it were a vertical connector.

Figure 4:
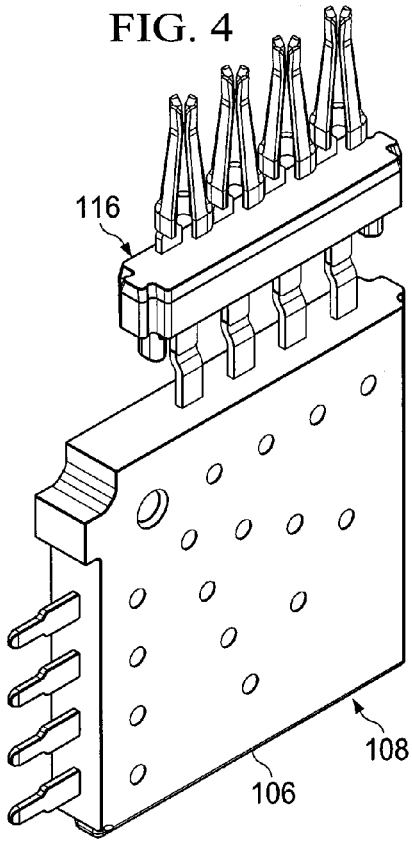
FIG. 4 is a top perspective view of a lead frame and female wafer assembly.

As shown in FIG. 4, an overmolded lead frame 106 can be connected to a wafer 116 to form a lead frame and wafer assembly 108. Vertical connector housing 102 fits over wafer 116 and helps secure lead frame and wafer assemblies 108 within right angle transition housing 104. Vertical connector housing 102 and right angle transition housing 104 can be secured to each other using fastening means, such as epoxy or ultrasonic welding, or other fastening members, such as screws, that can pass through openings in each of vertical connector housing 102 and right angle transition housing 104.

Figure 5:
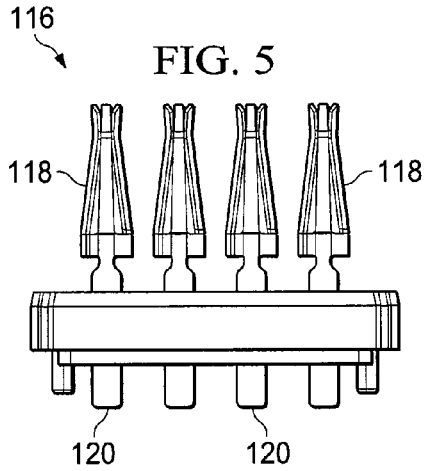
FIG. 5 is a side elevation view of a female wafer.
Figure 6:
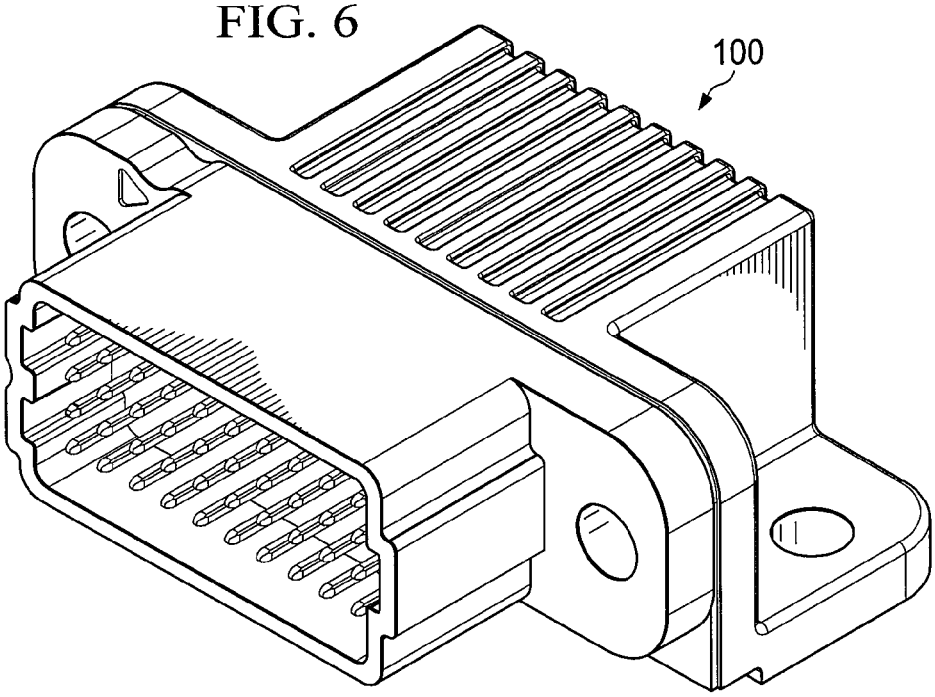
FIG. 6 is a top perspective view of a male right angle transition adapter.
Figure 7:
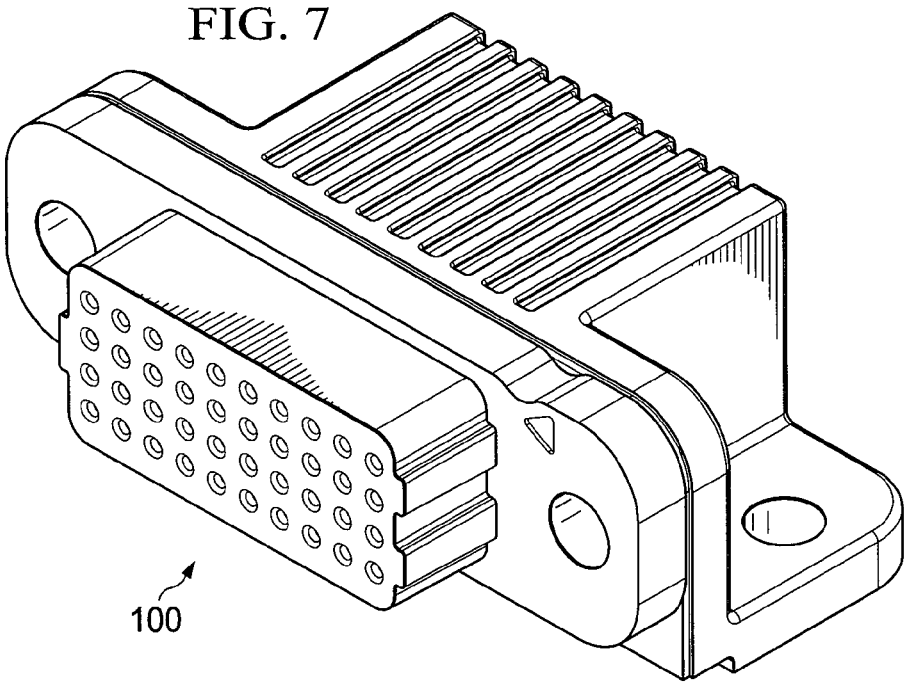
FIG. 7 is a top perspective view of a female right angle transition adapter.

As shown in FIGS. 1-4, attachment terminals 112 and first attachment tabs 114 are genderless, meaning that they are not limited to mating with only male or female connectors. As shown in FIG. 5, wafer 116 comprises a plurality of electrical contacts 118 and second attachment tabs 120. Electrical contacts 118 can be either pin contacts or socket contacts, thereby resulting in either a male or female right angle transition adapter 100. Male pin contacts 118 are depicted in FIGS. 1 and 6. Female socket contacts 118 are depicted in FIGS. 4, 5, and 7. A female electrical contact 118 preferably comprises a plurality of beams (e.g., four). Second attachment tabs 120 are bonded to first attachment tabs 114 of lead frame 106 to create lead frame and wafer assembly 108, as shown in FIG. 4.

As shown in FIG. 5, the design of wafers 116 allows for the ability to produce electrical contacts 118 from a longer pitch of material separately from or independently of the entire construction of wafers 116. After electrical contacts 118 are produced from the appropriate pitch of material, they are arranged into a desired configuration. The desired configuration or arrangement is then placed into a mold. Then, plastic is injected into the mold at the transition region (approximately the middle portion) of electrical contacts 118.

Lead frames 110 are created by stamping out leads from a piece of material where the stamped leads are initially connected by a tie-bar. A lead frame 110 is then placed into a mold. Then, plastic is injected into the mold to create an overmolded lead frame 106. After the plastic has hardened, the tie bars are removed. As shown in FIGS. 1-4, there are preferably four leads in each lead frame 110 for each overmolded lead frame 106, and each lead of lead frame 110 are disposed generally parallel to each other and transition the electrical connection to a right angle. Additional embodiments, not shown in the figures, contain 5, 6, 8, and 10 separate leads in each lead frame allowing connectors with 5, 6, 8, and 10 rows of contacts to be manufactured in the same manner as a four-row connector. Various detents and notches can be included in the design of overmolded lead frames 106 to provide more secure fitting next to one another or within vertical connector housing 102 or right angle transition housing 104.

After each one of wafers 116 is bonded to a corresponding overmolded lead frame 106, the plurality of lead and wafer assemblies 108 are arranged adjacently to one another. As shown in FIG. 1, electrical contacts 118 of the plurality of lead frame and wafer assemblies 108 are capable of being inserted into vertical connector housing 102. After the insertion of electrical contacts 118 into vertical connector housing 102, the remainder of the plurality of lead frame and wafer assemblies 108 are disposed within right angle transition housing 104. Vertical connector housing 102 and right angle transition housing 104 can then be secured together, for example, by fastening members, such as screws.

The present invention can provide a manufacturer with cost savings by allowing a manufacturer to benefit from economies of scale. The manufacturer can use common components for both vertical and right angle connectors. In particular, since overmolded lead frames 106 are genderless, they can be produced in greater volumes and subsequently used with either male or female wafers 116. Likewise, right angle transition housing 104 may be used to produce both male and female right angle connectors by being paired with either male or female vertical connector housings 102 and either male or female wafers 116. The use of male wafers 116 results in the right angle transition adapter depicted in FIG. 6, whereas the use of female wafer 116 results in the right angle transition adapter depicted in FIG. 7. For several components, instead of investing in capital equipment designed to produce both vertical and right angle connectors, a manufacturer can simply invest in one type of capital equipment for the production of common components. Additionally, as a result of using separate components for the contact portion (i.e., vertical connector housing 102) and the right angle portion (i.e., right angle transition housing 104) of the connector, simplified tooling is required for lead frames 110 and overmolded lead frames 106. This simplified tooling in turn results in lower manufacturing costs.

The present invention can be used, for example, to connect a daughtercard to a motherboard or a cable connector to a right angle board-mounted connector. Such connections can be useful, for example, in computer, server, and networking industries.

The present invention can also be used to transition connectors at angles other than right angles. This can be accomplished by adjusting the angle at which attachment terminals 112 are connected to first attachment tabs 114 and modifying either vertical connector housing 102 or right angle transition housing 104 to account for the non-right angle connection.

The invention claimed is:

1. A transition adapter affording an electrical connection at a right angle comprising:

a vertical connector housing;

a right angle transition housing connected to and forming a unitary transition adapter with the vertical connector housing, the vertical connector housing being interchangeable to allow the unitary transition adapter to receive either a male or a female mating connector;

at least one lead frame having at least one attachment terminal at one end and at least one first attachment tab at the opposite end, the at least one attachment terminal being oriented substantially at a right angle relative to the at least one first attachment tab; and at least one wafer having at least one second attachment tab and at least one electrical contact comprising either a pin or socket;

wherein said first attachment tab of said lead frame is attached to said second attachment tab of said wafer;

wherein said lead frame is housed within the right angle transition housing; and wherein said wafer is housed within the vertical connector housing.

2. The transition adapter of claim 1 wherein the angle is greater than or less than a right angle.

3. The transition adapter of claim 1 wherein the lead frame is an overmolded lead frame.

4. The transition adapter of claim 1 wherein the at least one electrical contact is a socket contact.

5. The transition adapter of claim 1 wherein the at least one electrical contact is a pin contact.

6. A method of using a transition adapter affording an electrical connection at a right angle, wherein the transition adapter comprises a vertical connector housing, a right angle transition housing, at least one lead frame having at least one attachment terminal, and at least one wafer having at least one electrical contact, comprising the steps of:

connecting the right angle transition housing to the vertical connector housing so as to form a unitary transition adapter;

connecting said attachment terminal to a horizontally connecting item;

connecting said electrical contact to a vertically connecting item; and connecting the unitary transition adapter to either a male or a female mating connector.

7. The method of claim 6 wherein the horizontally connecting item is a printed circuit board.

8. The method of claim 6 wherein the vertically connecting item is a vertical connector.

9. A method of assembling a transition adapter affording an electrical connection at a right angle, comprising the steps of:

providing a vertical connector housing that is interchangeable to fit either a male or a female mating connector;

providing a right angle transition housing;

providing at least one lead frame having at least one attachment terminal at one end and at least one first attachment tab at the opposite end, the at least one attachment terminal being oriented substantially at a right angle relative to the at least one first attachment tab;

providing at least one wafer having at least one second attachment tab and at least one electrical contact comprising either a pin or socket;

connecting the right angle transition housing to the vertical connector housing so as to form a unitary transition adapter, said step of connecting comprising:

attaching said first attachment tab of said lead frame to said second attachment tab of said wafer to form a lead frame and wafer assembly; and housing said lead frame and wafer assembly within the right angle transition housing and vertical connector housing.

10. A transition adapter affording an electrical connection at a right angle comprising:

a vertical connector housing;

a right angle transition housing connected to, and forming a unitary transition adapter with, the vertical connector housing;

at least one lead frame having at least one attachment terminal at one end and at least one first attachment tab at the opposite end, the at least one attachment terminal being oriented substantially at a right angle relative to the at least one first attachment tab; and at least one wafer having at least one second attachment tab and at least one electrical contact comprising either a pin or socket;

wherein said first attachment tab of said lead frame is attached to said second attachment tab of said wafer;

wherein said lead frame is housed within the right angle transition housing; and wherein said wafer is housed within the vertical connector housing.

11. The transition adapter of claim 10 wherein the angle is greater than or less than a right angle.

12. The transition adapter of claim 10 wherein the lead frame is an overmolded lead frame.

13. The transition adapter of claim 10 wherein the at least one electrical contact is a socket contact.

14. The transition adapter of claim 10 wherein the at least one electrical contact is a pin contact.

* * * * *